73-151 SR
12/30/86 OR 4,631,954

United States Patent [19]
Mills

[11] Patent Number: 4,631,954
[45] Date of Patent: Dec. 30, 1986

[54] APPARATUS FOR CONTROLLING A PUMPJACK PRIME MOVER

[76] Inventor: Manuel D. Mills, P.O. Drawer 1073, Midland, Tex. 79701

[21] Appl. No.: 634,544

[22] Filed: Jul. 25, 1984

Related U.S. Application Data

[63] Continuation-in-part of Ser. No. 442,848, Nov. 18, 1982, abandoned.

[51] Int. Cl.[4] ..... F04B 49/00; E21B 44/00
[52] U.S. Cl. ..... 73/151; 166/250; 417/12; 417/18
[58] Field of Search ..... 417/12, 18; 73/151; 166/250

[56] References Cited

U.S. PATENT DOCUMENTS 3,926,047 12/1975 Duke et al. ..... 73/151
3,951,209 4/1976 Gibbs ..... 73/151
4,286,925 9/1981 Standish ..... 417/18
4,363,605 12/1982 Mills ..... 73/151
4,487,061 12/1984 McTamaney et al. ..... 417/12

*Primary Examiner*—Howard A. Birmiel
*Attorney, Agent, or Firm*—Marcus L. Bates

[57] ABSTRACT

An improved pump control having a device for measuring relative movement between structural components of a pumpjack unit, and converting the movement into a signal which varies according to the magnitude of the movement. The signal is divided into an upstroke and downstroke component so that during one cycle of the pumping operation, the downstroke part of the signal can be analyzed. A selected part of the downstroke signal can be used to indicate a pump-off condition. The entire signal can also be treated to provide a plot having characteristics similar to a dynamometer card. The disclosure further sets forth a motion sensor which measures the characteristics of the motion induced into the pumpjack structure and provides a signal which can be used to shut-in the well each time a pump-off condition is reached by the bottom hole pump.

19 Claims, 11 Drawing Figures

APPARATUS FOR CONTROLLING A PUMPJACK PRIME MOVER

Reference is made to my co-pending patent application Ser. No. 442,848, filed Nov. 18, 1982, now abandoned, of which this patent is a continuation-in-part.

BACKGROUND OF THE INVENTION

Manuel D. Mills' U.S. Pat. No. 3,851,995 sets forth a pump-off control apparatus for a pumpjack unit. The control device senses a change in the normal movement of the rod string on the downstroke of the pumping cycle. As the fluid level within the borehole falls below the inlet of the downhole pump means, the occurrence of fluid pounding manifests a shock-like reaction in the rod string which is transferred uphole to the walking beam of a pumpjack. The sensing apparatus measures this change in movement and converts the fluid pounding reaction into a signal for a control circuit. The control circuitry is connected to de-energize the prime mover of the pumpjack apparatus for an interval of time which allows the fluid level in the borehole to recover.

The U.S. patents to Montgomery, et al. U.S. Pat. Nos. 3,817,094 and 3,838,597 illustrate well monitoring apparatus by which a load transducer is secured to the surface structure of the walking beam of a pumpjack unit, so that the transducer senses a change as the walking beam is bent or distorted due to the rod string load. The transducer generates a signal representative of load changes in the structure as the walking beam is rocked.

Reference is made to the above issued patents, to my previous patents, to the references cited during the prosecution thereof, and to the field of search referred to therein.

| REFERENCE TO THE PRIOR ART | |
|---|---|
| 2,070,320 | 3,851,995 |
| 2,107,151 | 3,926,047 |
| 2,163,665 | 3,951,209 |
| 3,817,094 | 3,965,736 |
| 3,824,851 | 4,043,191 |
| 3,838,597 | 4,058,757 |
| | 4,142,546 |

The present invention differs from the known prior art by the provision of means by which a signal is generated in response to movement between a main structural component of a pumpjack unit and a relative immovable other structure. The signal amplitude varies concurrently with the variation in stress and strain to which a pumpjack structural component is subjected. The structural component is deflected in a cyclic manner analogous to the cyclic and oscillatory movement of the walking beam of a pumpjack unit. The deflection is synchronized with, but not necessarily in phase with, the up and down stroke of the rod string. Nevertheless, the cyclical occurring deflection occurs one cycle for each reciprocal movement of the rod string, and therefore the resulting signal can be related to both position and tension associated with the rod string, for the reason that the magnitude of the deflection, or more exactly the change in magnitude of the deflection, is a direct result of the varying geometry of the pumpjack unit required to produce the oil well. This concept is not found in the foregoing patents cited herein.

SUMMARY OF THE INVENTION

This invention sets forth method and apparatus for controlling the operation of a production unit associated with the recovery of liquid from boreholes, and more specifically the invention is related to a production unit which utilizes a production string, such as a rod string, for reciprocating a downhole pump for lifting fluid to the surface of the ground. In the preferred embodiment of the invention, the control apparatus is used to control the operation of a pumpjack unit such as may be used in producing fluid from a wellbore.

The invention comprehends means for measuring relative movement between structural components of a pumpjack unit, wherein the movement is proportional to the cyclic induced strain effected into the rod string. The measurement is converted into a signal which varies according to the change in magnitude of the cyclic movement. A second signal is generated which is related to the upstroke and downstroke of the rod string so that the first signal can be divided into an upstroke and downstroke component. A selected part of the downstroke signal is employed to provide a pump-off signal, which is stored each time it reaches a predetermined magnitude or signal strength. The accumulation of a pre-determined consecutive number of pump-off signals triggers or initiates shut-down of the pumpjack unit. The pumpjack unit remains in shut-down configuration for a predetermined period of time, whereupon the pumping action is again carried out until the next pump-off condition is encountered, whereupon the pumpjack unit is again shut-down, with this operation continuing to thereby produce the well in the most efficient manner possible.

A sub-combination of this invention provides a means for sensing cyclic movement of the pumpjack structure; and, when this signal reaches a predetermined magnitude which is indicative of fluid pounding, the pumpjack unit is shut-down for a predetermined length of time, so that the production formation can recover and thereafter another production cycle is initiated.

Accordingly, a primary object of this invention is the provision of means for providing a signal having an amplitude related to the tension effected within a sucker rod string of a pumpjack unit.

Another object of the invention is to provide a control for a pumpjack unit which shuts in the unit whenever a pump-off condition is encountered.

A further object of this invention is the provision of a pumpjack unit control apparatus and method which measures relative movement between structural components of the pumpjack unit, converts the measurement into a signal of varying strength dependent upon the magnitude of the movement, relates the signal to the upstroke and downstroke of the pumping cycle, and uses the downstroke portion of the signal to shut-down the pumping action whenever the signal exceeds a predetermined magnitude.

Another and still further object of this invention is the provision of means for measuring cyclical movement of structure associated with a pumpjack unit, converting the measurement into a signal, and rendering the pumpjack unit inactive whenever the signal exceeds a predetermined magnitude.

A further object of this invention is the provision of method and apparatus for starting and stopping a pumpjack unit by analyzing deflection of a structural component of the pumpjack unit which is deflected in response to loads imposed on the horsehead of the walking beam, and treating the signal in a manner to start and stop the pumping action.

An additional object of this invention is the provision of method and apparatus for drawing a plot related to the stressstrain characteristics of structural components associated with a pumpjack unit, and relating the plot to the load lifted by the horsehead of the walking beam, to thereby enable the characteristics of the pumping unit to be analyzed.

Another object of this invention is to provide a signal which is related to the tension in a rod string by resiliently supporting a magnet in proximity of a transducer wherein the magnet cyclicly moves in response to cyclic movement of the pumpjack unit so that the resultant signal produced by the transducer can be used to determine a pump-off condition.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENT

Figure 1:
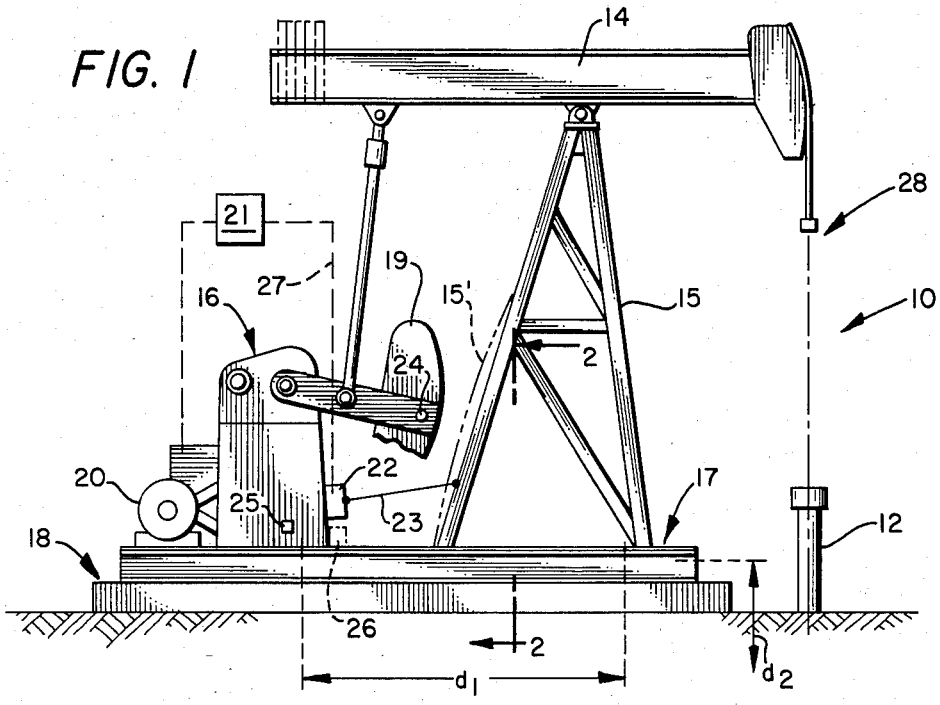
FIG. 1 is a side elevational view of an ordinary pumpjack unit having control apparatus associated therewith made in accordance with the present invention.

FIG. 1 discloses apparatus 10 by which fluid is lifted from a wellbore 12 to the surface of the ground. The preferred embodiment of the invention is employed in combination with an apparatus in the form of a pumpjack unit having a walking beam 14 journaled to a Samson post 15. The Samson post 15 and a gear box 16 are attached to a main frame 17. The main frame 17 often is supported on a concrete slab 18. The gear box provides a speedreducer which rotates a crank 19. The crank 19 includes the illustrated counterweight. A prime mover 20, in the form of an electric motor, drives the gear box. A controller 21 provides a signal by which the motor 20 starts and stops.

The Samson post 15, gear box 16, main frame 17, concrete slab 18, and motor frame are each rigidly affixed to one another and thereby forms structural components of the pumpjack unit.

A sensor 22, made in accordance with the present invention, provides means for measuring relative movement between variou different ones of the structural components, and converts the movement into a signal which varies according to the magnitude of the movement.

In the embodiment of FIG. 1, the dynamic sensor 22 is attached to the exterior of the gear box, and therefore moves there with. A tension member 23 is attached to one leg of the Samson post. A magnet 24 is attached to the crank. A sensor 25 is affixed to the gear box in a position to be placed in the flux lines of the magnet 24 each rotation of the crank 19.

Conductor 27 connects the dynamic sensor 22 to the controller 21. Numeral 28 broadly indicates a sucker rod and bridle assembly by which a downhole pump is reciprocated. Distance D1 is the measured distance between a location on Samson post 15 and a location on gear box 16.

Figure 2:
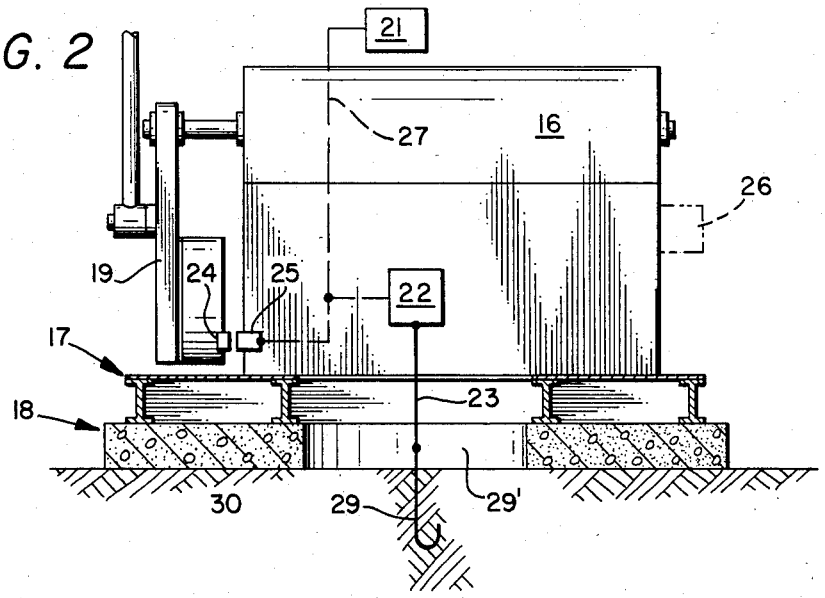
FIG. 2 is an enlarged, fragmented, cross-section view taken along line 2—2 of FIG. 1.

FIG. 2 discloses a ground anchor 29 buried within the ground 30 and connected to a dynamic sensor 22 by tension member 23 and extends through a conventional slot 29' which often is formed within the concrete base 18. Magnet 24 is aligned with magnetic sensor 25.

Throughout this disclosure like or similar numerals relate to like or similar elements.

Figure 3:
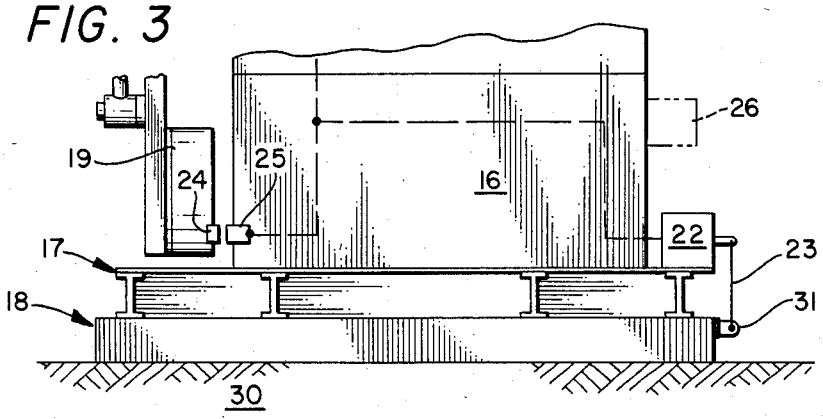
FIG. 3 is a fragmentary, elevational view of a modification of the apparatus disclosed in FIG. 2.

As seen in FIG. 3, the dynamic sensor 22 is affixed to main frame 17. The tension member 23 is connected to a bracket 31 which is rigidly affixed to the concrete slab 18.

Figure 4:
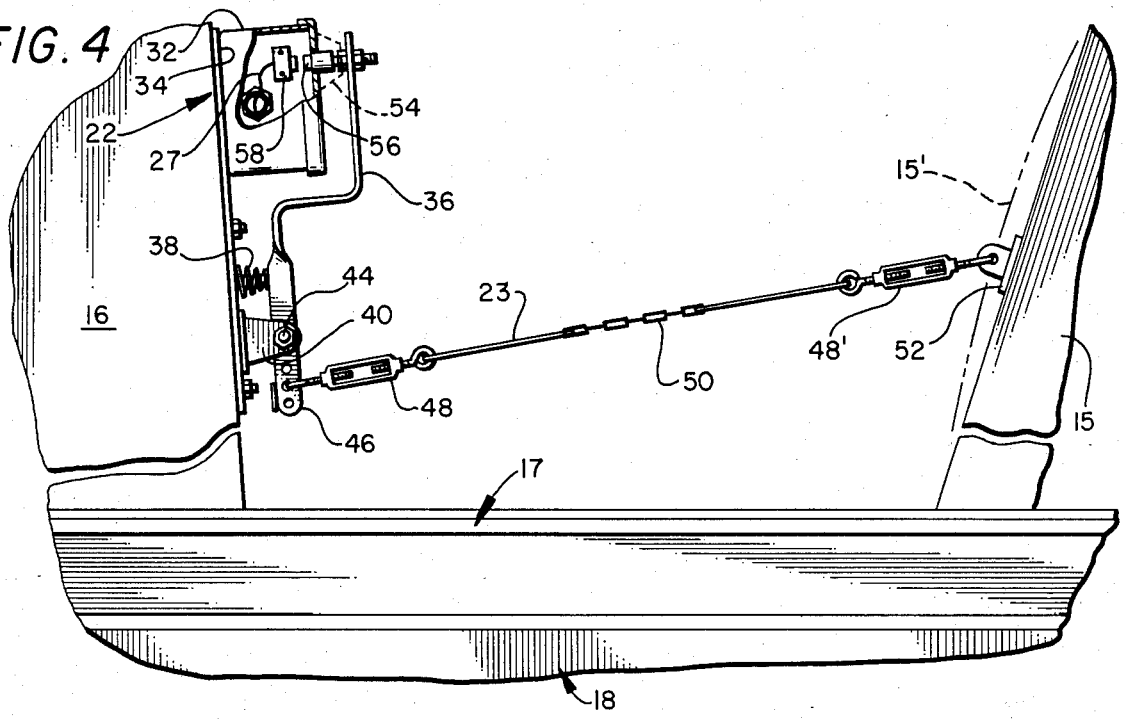
FIG. 4 is a fragmentary, part cross-sectional, side elevational view of part of the pumpjack unit disclosed in FIG. 1.

As seen in FIG. 4, the dynamic sensor 22, which is the means for measuring relative movement between two structural components 15 and 16, is housed within an enclosure 32. The enclosure is attached to the gear box 16 by means of a mount plate 34. A multiplying lever 36 is biased away from the enclosure by the illustrated return spring 38. Bell crank 40 is pivotally attached to the plate mount 34 and forms a pivot connection at 44 by which the lower marginal end of lever 36 is pivotally mounted respective to the enclosure 32. Apertures 46 are formed near the lower terminal end of lever 36 and changes the movement of the upper and lower parts of the lever. Adjustment means 48, such as a turn buckle, adjusts the tension in tie rod 50 and thereby positions the lever 36 within the optimum range of travel. Mount plate 52 attaches the other end of the tension member 23 to the Samson post 15. Numeral 15' exaggerates the slight movement or deflection that stress and strain from the pumping action cyclicly induces into the Samson post. A resilient cover 54, such as a fluted bell-shape rubber housing, is optionally provided to cover the illustrated aperture through which magnet 56 expends into the enclosure 22. Sensor 58 preferably is a Hall transducer which provides a signal related to the changing magnetic intensity which results from the magnetic flux generated at 56.

Figure 5:
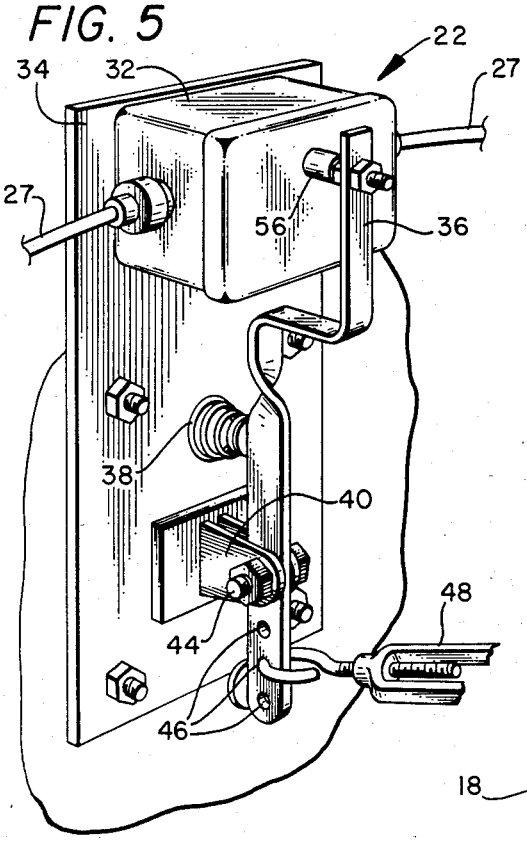
FIG. 5 is a perspective view of part of the apparatus disclosed in FIG. 4.

In FIG. 5, it will be noted that the upper end of lever 36 which supports the magnet 56 is provided with an adjustment means by which the relative position of the magnet can be adjusted respective to the lever 36.

Figure 6:
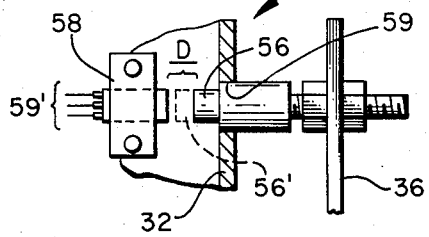
FIG. 6 is an enlarged, part cross-sectional view of part of the apparatus disclosed in FIG. 5.

In FIG. 6, the dynamic sensor 22 is completely isolated from ambient. The Hall transducer 58 is enclosed within enclosure 32 while the magnet 56 reciprocates through the aperture 59. The signal generated by the transducer 58 is connected to the controller 21 by means of connectors 59' which lead through conduit 27 of FIG. 5. The letter D illustrates the air gap which changes as the magnet 56 moves into position 56'.

Figure 7:
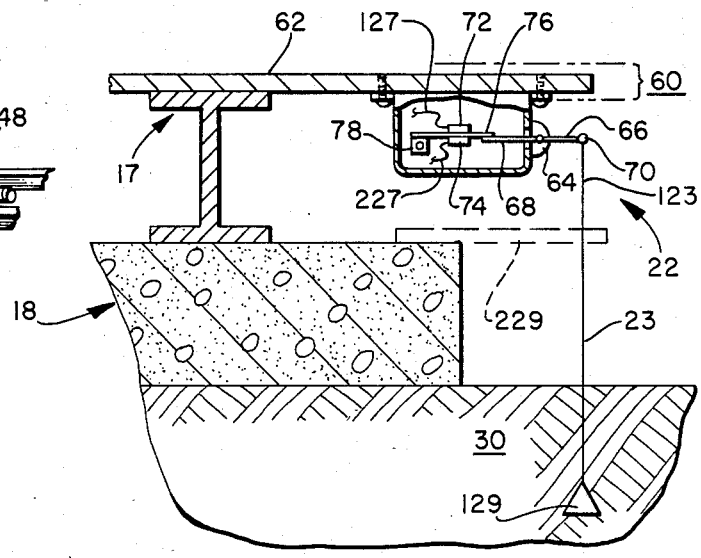
FIG. 7 is a fragmentary, part cross-sectional view of a modification of the apparatus disclosed in FIG. 4.

FIG. 7 discloses another embodiment of the dynamic sensor 22. The numeral 60 indicates the range of movement induced into plate member 62. The plate member 62 forms the upper surface of frame member 17. The sensor 22 is provided with a bell crank mount 64 to which there is pivotally received a lever 66. The lever has a free end 68 and an actuated end 70. The actuated end 70 is connected to a tension member 123 which in turn is anchored within the ground 30 at 129.

Strain gauges 72, 74 are attached to a resilient blade 76. One end of the blade is adjustably affixed at 78 to structure associated with the enclosure 132 within which the sensor is protectively housed. The details of the strain gauges 72, 74 and the Hall transducer are set forth in my co-pending patent application Ser. No. 442,848, filed Nov. 18, 1982.

Numeral 229 broadly indicates an anchor attached to the concrete slab 18, to which a tension member 123 can alternatively be connected in lieu of connecting the tension member as illustrated at 123 to anchor 129 located within soil 30.

Figure 8:
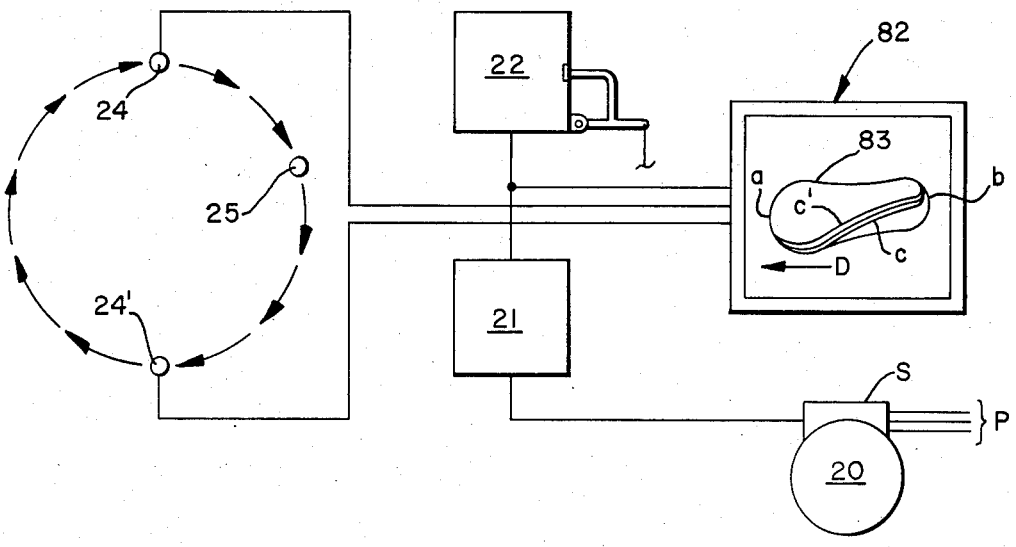
FIG. 8 is a block diagram which sets forth the method of the present invention.

FIG. 8 sets forth a block diagram illustrating the method of the present invention. In FIG. 8, motor 20, which drives the gear box, is provided with a starter S of conventional design, and is connected to a source of electrical power P, usually 440 V-3 phase. Control panel 21 starts and stops the pumpjack unit of FIG. 1 and therefore is connected to actuate the starter S of the conventional motor 20, in a manner fully set forth in my copending patent application Ser. No. 442,848 and my previously issued U.S. Pat. No. 3,851,995 to which references is made for further details of panel 21 and the operation of the pumpjack motor 20.

As seen in FIG. 8, the dynamic sensor 22 provides a signal to panel 21 by which the motor 20 is started and stopped. Magnet 25 and Hall transucers 24, 24', respectively, are positioned on the rotating crank or counterweight and pumpjack structure, respectively, in a manner whereby the relative position of the moving magnet and fixed sensors provide a signal indicative of the beginning of the downstroke and the beginning of the upstroke. The relationship between the fixed transducers 24, 24' is not necessarily 180° spacing as shown.

In FIG. 8, the apparatus 82 provides means for drawing a plot 83. Numeral "a" indicates the beginning of the upstroke, while numeral "b" indicates the beginning of the downstroke, and numeral "c" indicates that the well has progressively approached a pump-off condition atc'. The arrow at D is the direction of progression about the plot 83.

Figure 9:
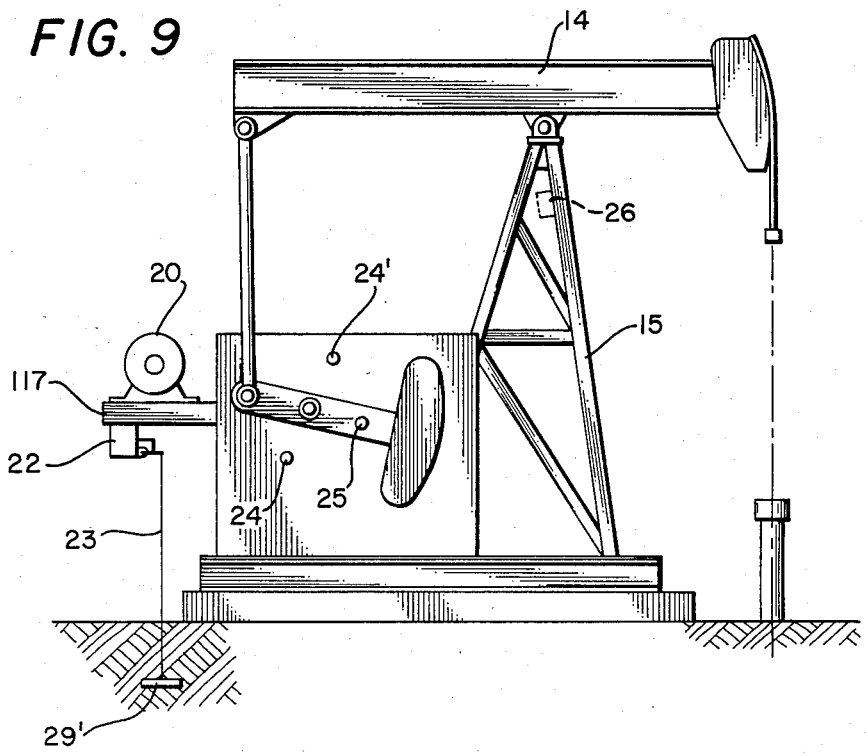
FIG. 9 is a side elevational view of another embodiment of the present invention.

FIG. 9 diagrammatically illustrates a conventional manner by which a pumpjack Samson post 15 and motor mount 117 are arranged on some known pumping units. The present invention is advantageously employed in conjunction with the pumpjack unit of FIG. 9 by mounting the dynamic sensor 22 out of the way below motor mount 117, and extending the tension member 23 to the anchor 29' located within the ground.

Figure 10:
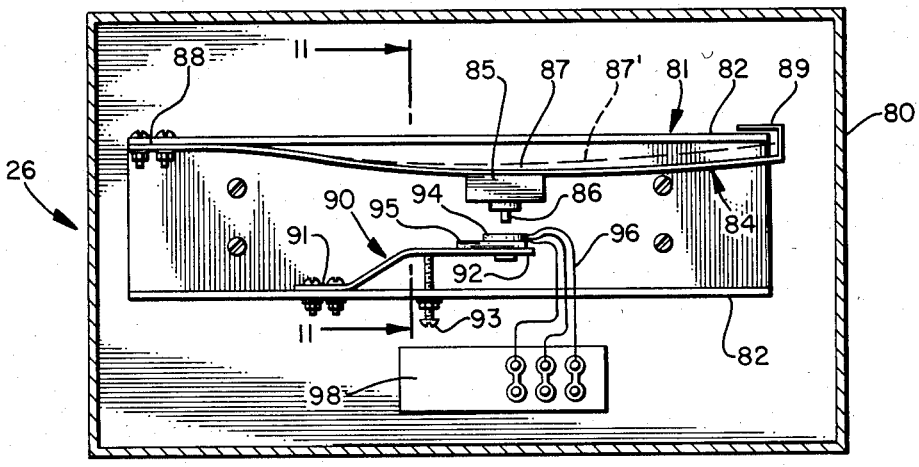
FIG. 10 is a side elevational view which sets forth the details of part of the apparatus disclosed in FIG. 1; and, FIG. 11 is a cross-sectional view taken along line 11—11 of FIG. 10.
Figure 11:
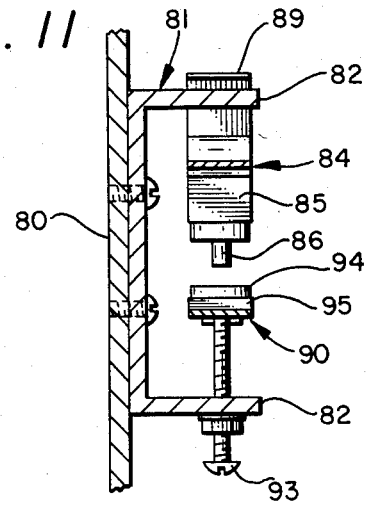

In FIG. 9, a sensor 26, made in accordance with FIGS. 10 and 11, is mounted to the Samson post near the journal thereof where a large movement of the structure will usually be found due to the inherent characteristics of such a structure, although the sensor can advantageously be mounted to other structures of the unit as indicated by the dot-dash lines in FIGS. 1 and 2, for example. The Hall transducers 24, 24' are mounted at the same radius from the crankshaft center as the magnet 24, in the before illustrated manner of FIGS. 1 and 2.

In FIGS. 10 and 11, there is disclosed the details of the auxiliary sensor 26 which comprises a sealed housing 80 having a mount bracket 81 secured to an interior wall thereof. The bracket preferably is U shaped having the illustrated spaced legs 82. An elongated metal spring 84 is provided with a weight 85 at a medial length thereof. Magnet 86 is adjustably attached to the weight 85 and moves therewith. The spring 84 is freely suspended along its major central length and has a bowed medial length 87, a fixed end 88, and a loosely captured end 89. End 89 is captured to a marginal end portion of mount member 82 by the illustrated two right angle bends formed at the marginal end of the spring, thereby enabling the spring to freely flex a limited amount in a vertical plane as indicated by the dot-dash line at 87'.

An adjustable sensor mount 90 is attached to the other bracket leg at 91, with the free marginal end 92 thereof supporting a Hall transducer 94. Insulation 95 isolates the transducer from the mount 90. Adjustment screw 93 positions the transducer 94 in confronting relationship respective to the magnet 86. Conductors 96 lead from transducer 94 to the terminal strip 98 and thence to the controller.

OPERATION

The present invention provides means for measuring relative movement between structural components of a pumpjack unit, and converting the movement to a signal which varies according to the magnitude of the movement. Means 24, 25 of FIG. 1 or 24, 24', 25 of FIGS. 8 and 9 are provided by which the signal is related to the upstroke and downstroke of the sucker rod string so that during one cycle of pumping, that is, the time intervals required for the sucker rod 28 to reciprocate down and up, the signal can be divided into an upstroke (a, 83, b, c in FIG. 8) and downstroke (b, c, a, FIG. 8). The invention further includes means by which a selected part (c—c' FIG. 8) of the downstroke is used to provide a pump-off signal. When the signal b, c, a provided at 22 exceeds a predetermined magnitude at c', the large signal is stored within the counting circuitry at 21, FIG. 8; and, when 3–5 sequential consecutive accumulated signals are stored at 21, starter S of motor 20 is shut down. Panel 21 maintains starter S in shut down configuration for a predetermined lapse of time, based on the history of the oil well; in order for the production formation to replenish the fluid in the bottom of the borehole. The timer at 21 then causes starter S to restart the motor 20, and production of the downhole formation again continues until another pump-off condition is encountered by the sensor 22. The structural components of a pumpjack unit includes all of the members thereof which are bolted, welded, and otherwise rigidly connected together to form a Samson post 15, gear box 16, main frame 17, and sometimes further includes a motor mount such as seen at 116 in FIG. 9. The slab and sometimes the ground 30 directly supports the main frame so the slab 18 and ground 30 are also considered structural components associated with a pumpjack unit.

The dynamic sensor 22 is connected to measure movement between a relatively fixed and movable structural components and includes the structural component in the form of the slab or ground as noted below.

The sensor 22 preferably is mounted in an area that has previously been analyzed to determine the magnitude of amplitude of cyclic movement induced between structural components as a result or indirect result of inducing reciprocating movement into the rod string 28. For example, in FIG. 1, there is always an appreciable amount of movement between the Samson post 15 and gear box 16, as indicated by the dot-dash line 15'. It is therefore advantageous to mount the tension member 23 at a position along the Samson post which is found to significantly deflect respective to the gear box. This deflection of the relatively fixed gear box and the relatively deflecting Samson post varies within a range of a few thousands of an inch to a quarter of an inch; and, this deflection can often be visually observed if an anchored or relative fixed reference point is provided. The deflection of the Samson post is a result of the distortion effected within various different ones of the structural members as a result of the varying load carried by the walking beam and transferred from the walking beam into the Samson post and gear box by theway of the crank arm. This force provided by the crank arm and transmitted through the pittman arm thereby provides a bending moment within the main frame 17, all of which jointly produce a significant cyclic variation in measured distance between the gear box and Samson post; or, the gear box and the ground; or, the gear box and selected parts of the platform; as well as the Samson post and the ground. This deflection can also be measured between the platform or main frame and the ground. The deflection often is manifested between portions of the main frame and the cement slab, especially where the slab has not been adequately grouted to the main frame.

The above deflection between various structural components of the pumpjack unit cyclicly varies each reciprocation of the rod string. The deflection, depending upon where it is measured, probably is out of phase with the tension in the rod string, however, this phase angle, whether it be zero degrees or 180 degrees, is not necessary to completely understand in order to comprehend the manner in which the present invention is carried out. One important consideration herein is to comprehend that cyclic deflective movement does occur between two or more of the recited structural components of a pumpjack unit and therefore, this cyclic mechanical movement, since it can easily be measured, can readily be converted into an electrical signal which also varies according to the magnitude of the movement and is reproducible each cycle of the pumpjack unit. The generated signal, if directly plotted as a graph on a recorder, would exhibit a sine wave pattern. This sine wave pattern can be stored if desired. It is preferred to treat the generated signal in a manner that resembles the well known dynamometer card, which is the plot 83 seen in FIG. 8. This is achieved by dividing the signal generated at 22, for example, into an upstroke and downstroke component by the employment of indexing means which correspond to the location of the sucker rod during the pumping cycle thereof. Since the crank 16 makes one revolution for each up and down stroke of the sucker rod, it is convenient to place two spaced sensors 25 rigidly affixed to structure associated with the pumpjack unit, such as the gear box, and to trigger the sensors with an apparatus timed with the crank 16, thereby enabling the two sensors of the trigger device to be timed in a manner whereby the traditional part of the plot 83 from a to b measures the change in sucker rod stress on the upstroke; and, the downstroke, as seen at a b c in FIG. 8. Electronically changing the sine wave pattern into a plot 83 is believed to be within the comprehension of those skilled in the art and therefore, the details of the various different circuitry which could be employed to achieve this end result is not more specifically set forth herein.

The sensitivity of the circuitry can be adjusted so that as a pump-off condition c, FIG. 8, is initially encountered, and grows in intensity towards position c', where severe fluid pounding is occurring, the motor can be shut down at any desired predetermined magnitude of fluid pounding. The history of the pump-off condition of the specific downhole production formation therefore dictates the most prudent choice within the range c, c' to cause panel 21 to shut down motor 20 by means of motor controller S. The prior art is replete with excellent examples of circuitry for shutting in the well for a predetermined time interval and then restarting the well, as for example, Applicant's above referred to issued patent.

In FIGS. 10 and 11, the motion sensor 26 preferably is placed on the gear box or Samson post, although it can be placed at other structural components of the well which move in synchronization with the pumping action. Normal cyclic recurring motion induced into the pumpjack structure causes the spring 87 to cyclicly move or flex as indicated by the dot-dash line 87'. The free end of spring 87 is captured at 89 so that extreme impact does not injure the magnet 86 and sensor 94, nor bend the springs 84, 80 out of adjustment. Normal motion or vibration occasioned by the operating pumpjack unit causes magnet 86 to vary in the spaced relationship respective to the Hall transducer 94, thereby providing a well defined signal of satisfactory amplitude. This signal is sensed by the panel 21, and when the amplitude of the signal increases to a value greater than normally provided by the apparatus, that is, when a pump-off condition is encountered, the shut down circuitry of panel 26 causes panel 21 to tell the motor controller to de-energize the motor 20.

In one of its broadest embodiments, the present invention comprehends measuring relative movement of structure associate with a pumpjack unit changing the movement into a signal, relating the signal to the pumping action and in particular to a pump-off condition, and shutting in the well when a pump-off condition is encountered.

This is achieved by measuring the deflection or relative movement effected between two rigid structural components of the pumpjack unit wherein the deflection results from the cyclic recurring varying geometry of the pumpjack unit during one cycle of the pumping operation.

Another embodiment of the invention comprehends resiliently suspending a mass which produces a magnetic field from pumpjack structure which deflects in timed sequence respective to cyclic pumpjack operation. A transducer is fixed in spaced relationship respective to the mass so that the pumping action induces cyclic relative motion between the magnetic field and the transducer. This provides a variable magnetic field about the transducer related to the varying geometry of the pumpjack unit, which is sensed by the transducer, so that the transducer generates a signal related to the pumping action of the pumpjack unit.

I claim:

1. In a control system for the control of a prime mover of an oil well pumpjack apparatus which drives a downhole pump by means of a rod string, wherein the pumpjack unit includes structural components affixed to one another for reciprocating the rod string, the improvement comprising:

control means by which the prime mover is selectively energized and de-energized;

means measuring relative movement between said structural components, and converting the measurement into a pump-off signal which varies according to the magnitude of the movement;

said structural components include a gear box driven by the prime mover, a walking beam supported on a Samson post and oscillated by the gear box; said means measuring relative movement is connected to measure the change in distance between the Samson post and the gear box;

means storing said pump-off signal and when a plurality of pump-off signals which exceed a predetermined magnitude are accumulated, said control means is de-energized for a finite period of time and thereafter again energized.

2. The improvement of claim 1 and further including means by which said pump-off signal is related to upstroke and downstroke of the pumpjack unit; and means by which a selected part of the downstroke signal is used to provide said pump-off signal.

3. The improvement of claim 1 wherein said means measuring relative movement is a magnet and a transducer; means supporting said transducer in spaced relation respective to said magnet; means resiliently supporting said magnet from one of said structural components so that as said one of said structural components moves respective to another of said structural components, said transducer generates said pump-off signal.

4. In a control system for the control of a prime mover of an oil well pumpjack apparatus which drives a downhole pump by means of a rod string, wherein the pumpjack unit includes structural components affixed to one another for reciprocating the rod string, the improvement comprising:

control means by which the prime mover is selectively energized and de-energized;

means measuring relative movement between said structural components, and converting the measurement into a pump-off signal which varies according to the magnitude of the movement;

means storing said pump-off signal and when a plurality of pump-off signals which exceed a predetermined magnitude are accumulated, said control means is de-energized for a finite period of time and thereafter again energized;

said pumpjack apparatus includes a gear box driven by the prime mover, and a main frame for supporting the gear box, said means measuring relative movement is connected between the gear box and the main frame of the pumpjack unit.

5. In a control system for the control of a prime mover of an oil well pumpjack apparatus which drives a downhole pump by means of a rod string, wherein the pumpjack unit includes structural components affixed to one another for reciprocating the rod string, the improvement comprising:

control means by which the prime mover is selectively energized and de-energized;

means measuring relative movement between said structural components, and converting the measurement into a pump-off signal which varies according to the magnitude of the movement;

means storing said pump-off signal and when a plurality of pump-off signals which exceed a predetermined magnitude are accumulated, said control means is de-energized for a finite period of time and thereafter again energized;

said pumpjack apparatus includes a ground supported main frame; said means measuring relative movement is connected to measure movement between the main frame of the pumpjack unit and the ground.

6. In a control system for the control of a prime mover of an oil well pumpjack apparatus which drives a downhole pump by means of a rod string, wherein the pumpjack unit includes structural components affixed to one another for reciprocating the rod string, the improvement comprising:

control means by which the prime mover is selectively energized and de-energized;

means measuring relative movement between said structural components, and converting the measurement into a pump-off signal which varies according to the magnitude of the movement;

means storing said pump-off signal and when a plurality of pump-off signals are accumulated, said control means is de-energized for a finite period of time and thereafter again energized;

said pumpjack apparatus is ground supported and said means measuring relative movement is connected between one of the structural components and the ground.

7. The improvement of claim 6 wherein said means measuring relative movement includes a magnetic field generator, means resiliently suspending said generator from one of said structural components; a transducer means placed within said magnetic field and fixed to said one of said structural components;

so that as said one structural component moves respective to another of said structural components, the magnetic field causes said transducer to generate the recited pump-off signal.

8. In a control system for the control of a prime mover of an oil well pumpjack apparatus which drives a downhole pump by means of a rod string, wherein the pumpjack unit includes structural components affixed to one another for reciprocating the rod string, the improvement comprising:

control means by which the prime mover is selectively energized and de-energized;

means measuring relative movement between said structural components, and converting the measurement into a pump-off signal which varies according to the magnitude of the movement;

means storing said pump-off signal and when a plurality of pump-off signals are accumulated, said control means is de-energized for a finite period of time and thereafter again energized;

said pumpjack apparatus includes the following structural components: a ground supported main frame, a Samson post, a gear box driven by said prime mover;

said means measuring relative movement is connected to measure movement between one of said structural components and the ground.

9. The improvement of claim 8 wherein said means measuring includes a transducer for measuring change in flux density; said transducer being attached to one structural component;

a flux generating member attached to another structural component which moves respective to the first structural component, said flux generator being placed closely adjacent to said transducer to thereby vary the lines of flux as the members vary in distance from one another.

10. The improvement of claim 9 wherein said flux generator is a magnet placed on one end of a lever with said lever being pivoted to one said structural member, there being an actuating member connected from the other end of the lever to a second structural component so that mechanical advantage can be achieved and the movement amplified mechanically.

11. In an oil well pumpjack apparatus having a main frame, a gear box supported on said main frame, and a Samson post affixed to said main frame, said apparatus having a prime mover which is connected to drive said gear box, a rocking beam journaled to said Samson post and connected to be rocked by said gear box, said rocking beam being connected to reciprocate a downhole pump by means of a rod string, and control means by which the prime mover is selectively energized and de-energized; an improved control system for said prime mover comprising:

means for measuring relative movement between said gear box and said Samson post; means by which the measured movement is converted into a signal which varies proportional to the magnitude of the measured movement;

means by which said signal is connected to cause said control means to de-energize said prime mover when the signal amplitude exceeds a predetermined magnitude which is indicative of a pump-off condition.

12. The control system of claim 11 wherein said means for measuring relative movement includes a magnetic field generator, means resiliently suspending said generator from one of said Samson post and gear box; a transducer means placed within said magnetic field and fixed to the other of said Samson post and gear box;

so that as said gear box moves respective to said Samson post, the magnetic field causes said transducer to generate the recited pump-off signal.

13. The control system of claim 11 wherein said means measuring relative movement is a magnet and a transducer; means supporting said transducer is spaced relation respective to said magnet; means resiliently supporting said magnet from one of said Samson post and gear box so that as said one of said Samson post and gear box moves respective to the other said transducer generates said pump-off signal.

14. In a pumpjack apparatus of the type having structural componets spaced from one another and attached together to thereby reciprocate a rod string which extends downhole in a borehole, said structural components including a main frame, a gear box, and a Samson post, a prime mover connected to drive said gear box, means connecting said gear box to rock a rocking beam and thereby reciprocate the rod string, with said prime mover having control means by which it is selectively energized and de-energized, the method of controlling the prime mover according to the steps of:

measuring the change in distance between two of said structural components as a result of stress and strain induced by the pumping action;

converting the measured change in distance into a pump-off signal which varies according to the magnitude of the movement;

storing the pump-off signals which exceed a predetermined magnitude;

accumulating a plurality of stored pump-off signals and using the stored signals to cause the control means to de-energize said prime mover.

15. The method of claim 14 and further including the steps of:

relating the pump-off signal to upstroke and downstroke of the sucker rod string;

selecting part of the downstroke signal as a stored pump-off signal.

16. The method of claim 14 wherein the measuring step is carried out by attaching a sensor between of said two structural components, wherein said sensor generates a variable current in response to the magnitude of deflection of said two structural components; and, using the generated current as the converted signal.

17. The method of claim 14 wherein the measuring step is carried out by arranging a magnet in close proximity to a transducer and inducing movement between the magnet and the transducer in response to relative movement of a second structural component respective to a first component;

thereby generating said signal.

18. The method of claim 14 and further including the steps of:

resiliently attaching a magnetic field generating means to said one structural component so that as the structural component moves in response to the pumping action, the magnetic field moves in harmony therewith;

fixing a transducer to said one structural component with said transducer arranged within the magnetic field; said transducer provides an electrical signal proportional to the magnetic field; and using the transducer for measuring the variation in the magnetic field so that said transducer provides said pump-off signal.

19. The method of claim 14 and further including the steps of:

mounting a transducer in fixed relationship respective to said structural component, said transducer has a signal output which is related to the intensity of a surrounding magnetic field;

resiliently mounting a magnet means to said structural component with said magnet means generating a field, placing the transducer within the magnetic field;

whereby the output from the transducer is said pump-off signal.

* * * * *